United States Patent [19]

Oguri et al.

[11] Patent Number: 4,718,846

[45] Date of Patent: Jan. 12, 1988

[54] COMBUSTION SAFETY DEVICE FOR A GAS HEATER

[75] Inventors: Minoru Oguri, Gifu; Wakizi Sugimoto, Aichi, both of Japan

[73] Assignee: Rinnai Corporation, Japan

[21] Appl. No.: 707,117

[22] Filed: Feb. 28, 1985

[30] Foreign Application Priority Data

Apr. 14, 1984 [JP] Japan ..... 59-75568

[51] Int. Cl.[4] ..... F23N 5/00

[52] U.S. Cl. ..... 431/76; 126/92 AC; 431/80

[58] Field of Search ..... 431/76, 77, 80, 328; 126/92 AC

[56] References Cited

U.S. PATENT DOCUMENTS

| | | | |
|---|---|---|---|
| 1,814,076 | 7/1931 | Carnahan | 431/77 |
| 2,348,965 | 5/1944 | Dougherty | 431/77 |
| 2,361,294 | 10/1944 | Jones | 431/76 |
| 2,474,547 | 6/1949 | Patch | 431/80 |
| 2,874,763 | 2/1959 | Hobbs | 431/76 |
| 3,689,194 | 9/1972 | Das et al. | 431/80 |
| 3,699,905 | 10/1972 | Gach et al. | 431/80 |
| 3,918,880 | 11/1975 | Risse | 431/76 |
| 4,032,286 | 6/1977 | Kobayashi et al. | 431/76 |
| 4,140,475 | 2/1979 | Wolfe | 431/76 |
| 4,395,226 | 7/1983 | Nakanishi et al. | 431/76 |
| 4,396,370 | 8/1983 | Yamara et al. | 431/76 |
| 4,398,882 | 8/1983 | Yamana | 431/80 |
| 4,406,613 | 9/1983 | Naito et al. | 431/76 |
| 4,416,615 | 7/1984 | Inoue | 431/76 |
| 4,447,204 | 5/1984 | Isenberg | 431/76 |
| 4,608,012 | 8/1986 | Cooper | 431/328 |

FOREIGN PATENT DOCUMENTS

| | | | |
|---|---|---|---|
| 0007850 | 1/1978 | Japan | 431/76 |
| 0125541 | 9/1979 | Japan | 431/76 |
| 0205122 | 10/1985 | Japan | 431/75 |

*Primary Examiner*—Samuel Scott
*Assistant Examiner*—H. A. Odar
*Attorney, Agent, or Firm*—Nilsson, Robbins, Dalgarn, Berliner, Carson & Wurst

[57] ABSTRACT

A combustion safety device for the counter-action against oxygen deficiency in a gas heater which is provided with a main burner of the surface combustion type and with an oxygen-deficiency detecting burner of a Bunsen type, in which a primary-air hole of the oxygen deficiency detecting burner is made to communicate with the primary-air supply chamber or distributing chamber of the main burner.

19 Claims, 8 Drawing Figures

COMBUSTION SAFETY DEVICE FOR A GAS HEATER

PRIORITY CLAIM

This application claims priority under 35 USC 119 from Japanese Patent application Ser. No. P59-75568 filed Apr. 14, 1984.

FIELD OF THE INVENTION

The field of art to which the invention pertains is the field of combustion safety devices for gas heaters.

BACKBROUND AND SUMMARY OF THE INVENTION

The present invention relates to a combustion safety device for the counteraction against oxygen deficiency in a gas heater which is provided with a main burner of the surface combustion type. A conventional device known as the combustion safety device for the counteraction against oxygen deficiency has a construction in which a thermoelectromotive element faces a burner and an electromagnetic safety valve, provided intermediately in a path for supplying gas to said burner, is opened and kept open by a prescribed electromotive force generated from the thermoelectromotive element in the normal combustion of the burner. The safety valve is closed to stop the combustion of this burner when burning flames of the burner lift and break away from the thermoelectromotive element in the condition of deficiency of oxygen and consequently the electromotive force generated from said element falls below the breakaway voltage of the electromagnetic safety valve.

However, when this device is applied to a burner of the surface combustion type, by making the thermoelectromotive element face the combustion surface of said burner, it takes a long time for the electromotive force of said element to fall below the breakaway voltage owing to the flame sustaining effect and the thermal radiation, both caused by the combustion surface being red hot. Therefore it is not preferred to apply said device for counteracting the deficiency of oxygen in a burner of the surface combustion type.

For this purpose, a conventional gas heater having such a burner of the surface combustion type is provided with the oxygen-deficiency detecting burner of the Bunsen type. The thermoelectromotive element facing this burner and the electromagnetic safety valve provided therein are controlled to open and close on the basis of whether the electromotive force generated from said thermoelectromotive element is larger or smaller than the breakaway voltage.

When oxygen becomes deficient due to the shortage of secondary air or any other cause in this heater, the electromotive force of the thermoelectromotive element falls immediately below the breakaway voltage and thereby the electromagnetic safety valve is closed to stop desirably the combustion of said burner of the surface combustion type. However, when oxygen is deficient due to the blockade of the damper of the primary air intake port of a primary-air supplying chamber or clogging caused by dust or the like, the oxygen-deficiency detecting burner cannot work successfully. Consequently the electromagnetic safety valve is kept opened; hence, the faulty burning of the burner of the surface combustion type continues undesirably.

The present invention aims to furnish a combustion safety device which makes it possible to detect even the deficiency of primary air in a main burner and thereby to close the electromagnetic safety valve so as to stop combustion successfully. A device is provided with a main burner of the surface combustion type which has a distributing chamber supplying a fuel-air mixture to a combustion surface and a primary-air supplying chamber at the end of the burner communicating with said distributing chamber, and with the oxygen-deficiency burner, characterized in accordance with this invention in that a primary-air hole of this oxygen-deficiency detecting burner is made to communicate with said primary-air supplying chamber or said distributing chamber.

DETAILED DESCRIPTION

Figure 1:
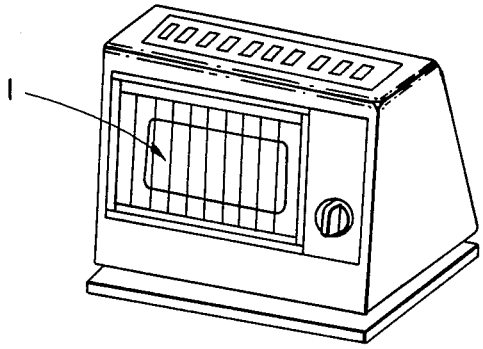
FIG. 1 is a perspective view of one example of gas heaters provided with the device of the present invention.
Figure 2:
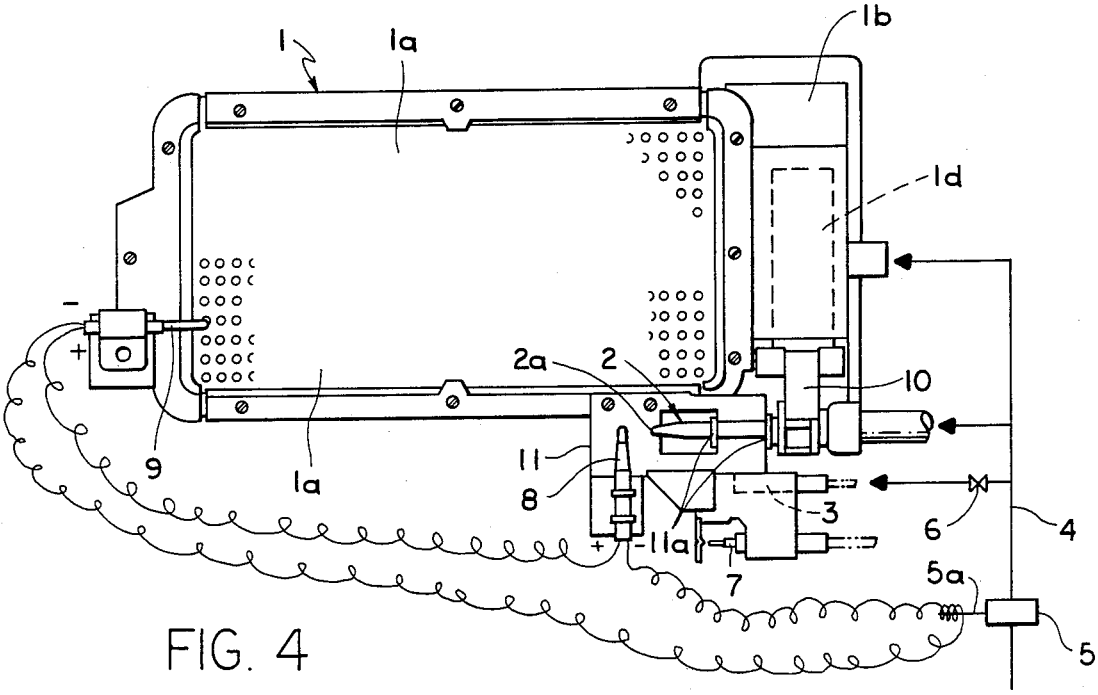
FIG. 2 is a front view of a first embodiment of the present invention.

The following is a description of the present invention with reference to a first embodiment thereof. FIG. 1 shows a gas infrared heater, which is a gas heater provided with the device of the present invention. Referring additionally to FIG. 2, in the body of this heater there is provided a main burner 1 of the surface combustion type having a combustion surface 1*a* formed of a multihole ceramic plate or the like, an oxygen-deficiency detecting burner 2 of a Bunsen type and an ignition burner 3. By an igniting operation, an electromagnetic safety valve 5 provided intermediately in a common gas supplying path 4 communicating with said burners 1, 2 and 3 is pressed to open, while an ignition valve 6 communicating with said ignition burner 3 is opened and an igniter 7 is operated. Then a fire spreads to ignite said main burner and said oxygen-deficiency detecting burner 2 through said ignition burner 3. With the discontinuation of the igniting operation, said igniter 7 stops operation and simultaneously said ignition valve 6 closes, whereby the fire of the ignition burner 3 is extinguished.

Referring more particularly to FIG. 2, a first thermocouple 8 comprises a thermoelectromotive element facing the burner port 2*a* of the oxygen-deficiency detecting burner 2. It is possible to open said electromagnetic safety valve 5, and keep it opened only by the electromotive force of this first thermocouple 8. However, when a gas such as a coal gas which does not rise readily is used in this case, flames from said oxygen-deficiency detecting burner 2 rise sluggishly, and consequently the output of the first thermocouple 8 decreases relatively slowly.

Therefore, it takes a long time for said electromotive force to fall below the breakaway voltage in the oxygen deficient state, and thus the stoppage of burning of said main burner 1 by the closing of the electromagnetic safety valve 5 is delayed. In order to close said electromagnetic safety valve 5 speedily and thereby to stop the burning of the main burner 1 speedily, a second thermocouple 9 facing the combustion surface 1*a* of the main burner 1 is provided additionally to said first thermocouple 8, in the first embodiment shown in the figure, and the two thermocouples 8 and 9 are connected in reverse polarity to each other so as to lower the level of the electromotive force of the first thermocouple 8 by that of the second thermocouple 9. The electromotive force of the first thermocouple 8 thus lowered in level is impressed on the operating solenoid 5*a* of said electromagnetic safety valve 5 so that this impressed voltage is of a relatively low value above the breakaway voltage of the valve 5 in normal burning, but of a value sufficient for attracting this valve 5 and maintaining it opened, and that the voltage impressed on said operating solenoid 5*a* is changed so as to be of a value below the breakaway voltage by the slight lowering of the electromotive force of the first thermocouple 8 in the deficiency of oxygen.

The electromotive force of the second thermocouple 9 is maintained virtually unvaried due to the flame sustaining effect and the thermal radiation, both caused by the combustion surface of the main burner 1 being red hot even when the primary air in the main burner 1 is deficient. Thus the electromagnetic safety valve 5 is not closed unless the electromotive force of the first thermocouple 8 decreases.

To cope with this, the primary air hole 2*b* of the oxygen-deficiency detecting burner 2 is made to communicate with the primary-air supplying chamber 1*b* of the main burner 1 or the distributing chamber 1*c* thereof according to the present invention. The details of this construction are shown in FIGS. 3 and 4.

Figure 4:
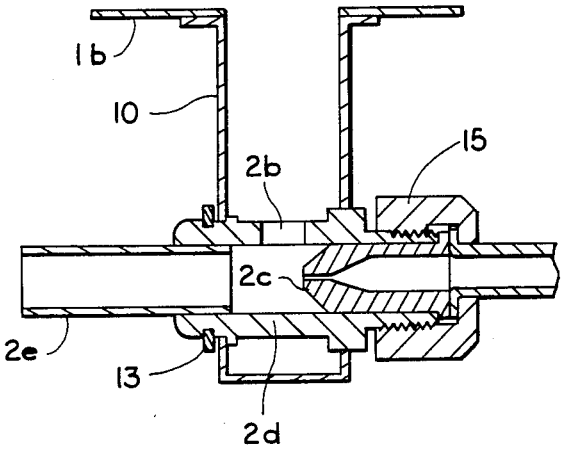
FIG. 4 shows a cutaway front view of the principal part of the first embodiment of FIG. 2.
Figure 3:
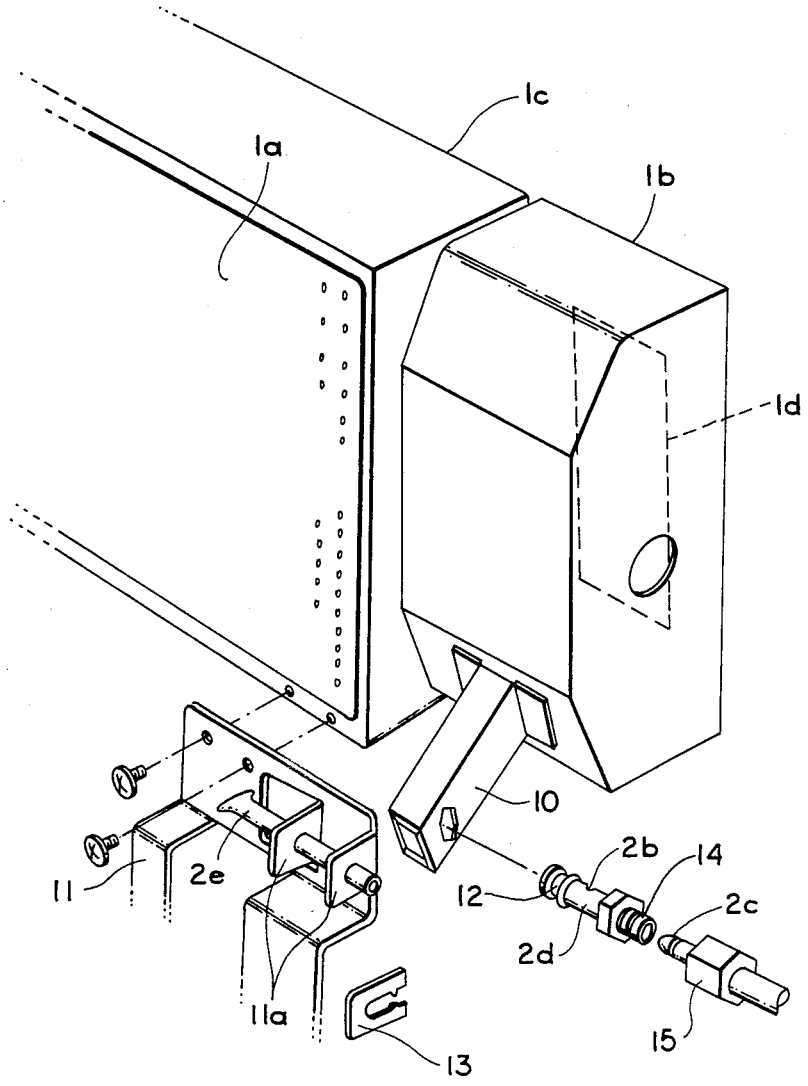
FIG. 3 is an exploded perspective view of the principal part of the first embodiment of FIG. 2.

As illustrated in FIGS. 3 and 4, the oxygen-deficiency detecting burner 2 consists of a nozzle member 2*c* communicating with the gas supplying path 4, a mixing tube member 2*d* having the primary-air hole 2*b* and a burner head 2*e* having a burner port 2*a* at the tip. In the embodiment illustrated in FIGS. 3 and 4, a square-tube-shaped primary-air duct 10 having a closed-up end is projected obliquely downward from the lower portion of the primary-air supplying chamber. Said mixing tube member 2*d* is laid through and supported by said primary-air duct 10. A supporting member 11 supports the ignition burner 3 and igniter 7 and the first thermocouple 8 is fitted to the lower edge of the main burner 1. The burner head 2*e* is put through and supported by bent pieces 11*a* of said supporting member 11, the nozzle member 2*c* is fitted in one end opening of the mixing tube member 2*d* while the burner head 2*c* is fitted in the other end of said mixing tube member 2*d*. An engagement member 13 is engaged with a groove 12 formed on the outer periphery of one of the mixing tube member 2*d*, and a cap nut 15 on said nozzle member 2*c* is screwed on an external thread 14 formed on the outer periphery of the other end of the mixing tube member 2*d*. In the above-described construction, each member and portion of the oxygen-deficiency detecting burner 2 is integrated with others and the primary-air hole 2*b* of the mixing tube member 2*d* is made to communicate with the primary-air supplying chamber 1*b* through the primary-air duct 10.

In FIGS. 2 and 3, the primary-air intake port of the primary-air supplying chamber 1*b* is designated 1*d*.

Figure 5:
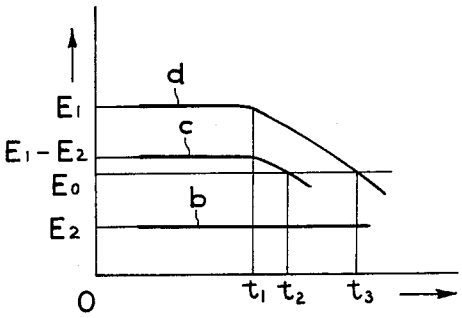
FIG. 5 is a diagram showing changes in the electromotive force of each thermocouple and in a voltage impressed on an operating solenoid.

Next, a description will be made of the operation of the device based on the above-described embodiment. After ignition, the first thermocouple 8 is exposed to the burning flames of the oxygen-deficiency detecting burner 2, while the second thermocouple 9 is heated by the radiant heat from the combustion surface 1*a* of the main burner 1, and both the thermocouples are heated continuously. Consequently the electromotive forces of the thermocouples 8 and 9 are maintained at prescribed voltages $E_1$ and $E_2$ indicated by lines a and b of FIG. 5, respectively. A voltage impressed on the operating solenoid 5*d*, which is obtained by subtracting the electromotive force of the thermocouple 9 from that of the first thermocouple 8, is maintained at a value higher than a breakaway voltage $E_0$ indicated by a line c of FIG. 5. Thereby the electromagnetic safety valve 5 is kept opened and the main burner 1 performs normal burning.

In the case when the main burner 1 is put thereafter in the oxygen deficient state due to unexpected blocking of the primary-air intake port 1*d* of the primary-air supplying chamber 1*b* of the main burner 1 or by clogging caused by dust or the like, the conventional device described previously, which has the oxygen-deficiency detecting burner 2 of the type in which primary air is taken in irrespective of the primary-air supplying chamber 1*b*, cannot detect that dangerous state. To the contrary, in the device of the present invention, which is provided with the oxygen-deficiency detecting burner 2 of the type in which the primary air is taken in from said primary-air supplying chamber 1*b*, the oxygen-deficiency detecting burners 2 is also put in the oxygen deficient state, in that case, with the burning flames thereof rising, and the electromotive force of the first thermocouple 8 decreasing from this time point, i.e. a time point $t_1$ of FIG. 5. Therefore the voltage impressed on the operating solenoid 5*a* reaches the breakaway voltage $E_0$ at a time point $t_2$, the electromagnetic safety valve 5 is closed, and thus the fire of the main burner 1 is extinguished safely.

Figure 6:
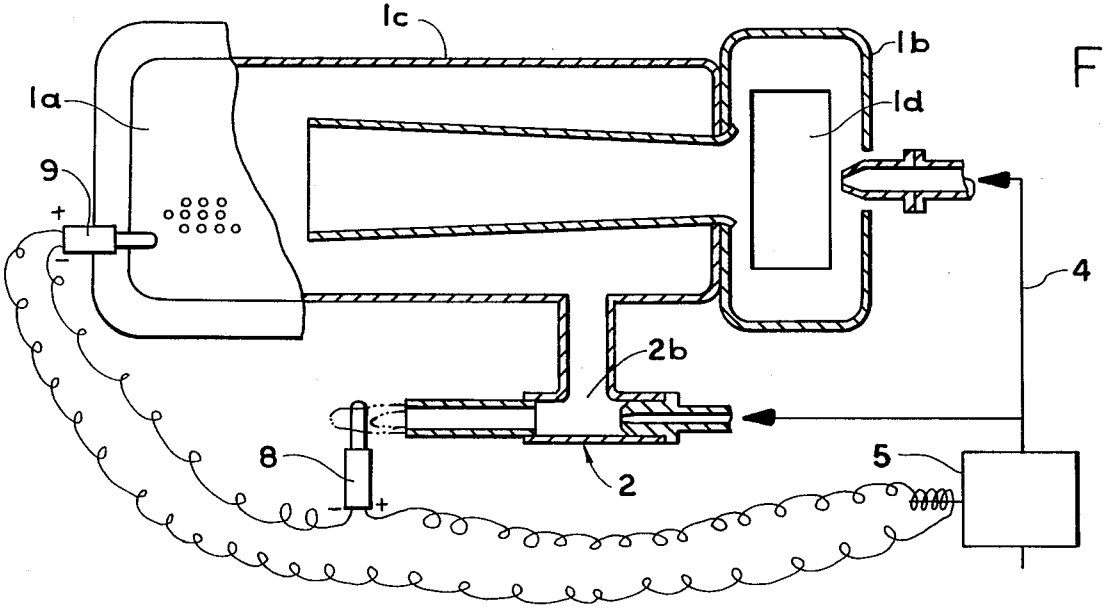
FIG. 6 shows a partially-cutaway front view of a second embodiment of the present invention.

FIG. 6 shows a second embodiment of the present invention, which is different from the first embodiment only in that the primary-air hole 2*b* of the oxygen-deficiency detecting burner 2 is made to communicate with the distributing chamber 1*c* of the main burner 1.

Figure 8:
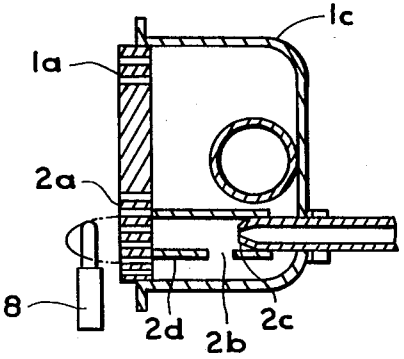
FIG. 8 shows a cut side of the principal part of the third embodiment of FIG. 7.
Figure 7:
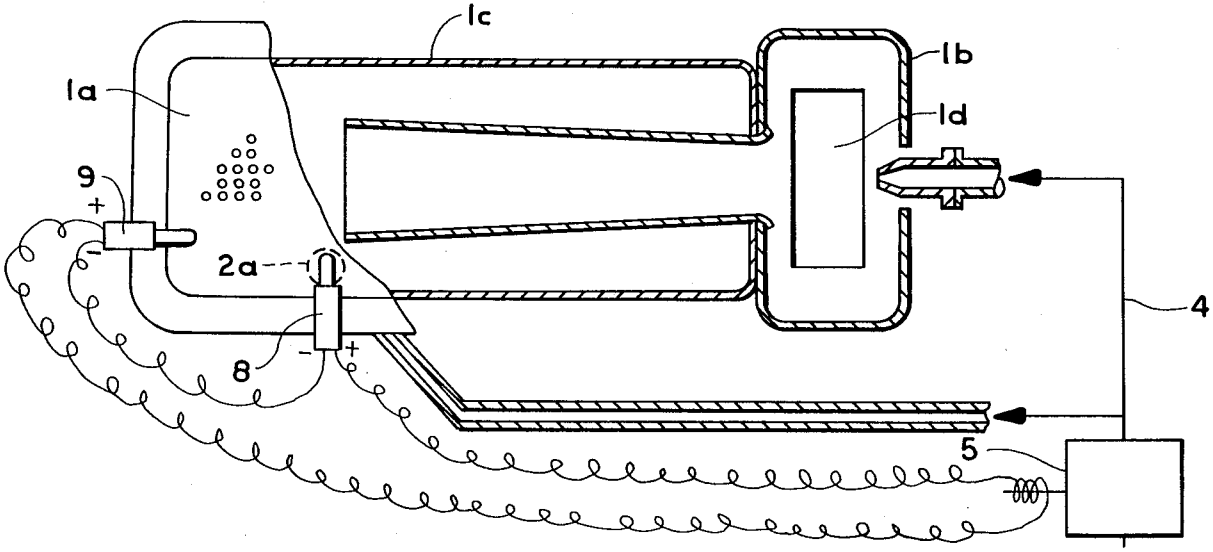
FIG. 7 shows a partially-cutaway front view of a third embodiment of the present invention.

FIGS. 7 and 8 show a third embodiment of the present invention, which differs from said first embodiment only in that the path for supplying gas to the oxygen-deficiency detecting burner 2 is made to communicate with the distributing chamber 1*c* of the main burner 2, that the mixing tube member 2*d* of the burner 2 is disposed in said distributing chamber 1*c*, and that the burner head 2*e* is formed of a part of the combustion surface 1*a* of the main burner 1.

There is no particular difference between the constructions of other parts of the second and third embodiments and those of the first embodiment.

According to the second and third embodiments, the fuel-air mixture is supplied to the primary-air hole 2*b* of the oxygen-deficiency detecting burner 2, and consequently the burning flames of this burner 2 rise somewhat higher than those in the first embodiment even in the normal burning of the main burner 1. This causes no problem, since the distance between the burner port 2*a* of the oxygen-deficiency detecting burner 2 and the first thermocouple 8 can be adjusted to make the latter generate the electromotive force $E_1$ and thus the operation and effect of the present invention can be secured.

As described above, the oxygen deficient state, due to the shortage of primary air in the main burner alone, which cannot be detected by the conventional oxygen-deficiency detecting burner provided separately and independently from the main burner, can be detected by the oxygen-deficiency detecting burner according to the present invention, since the primary-air hole of this burner is made to communicate with the primary-air supplying chamber of the main burner or the distributing chamber thereof. Thereby the electromagnetic safety valve can be closed to stop the faulty burning of the main burner, which results in the effect of a further improvement in the safety of a gas heater.

We claim:

1. A safety apparatus for interrupting the supply of a gaseous fuel to an air-fuel combustion burner when the air which is supplied to the burner is oxygen-deficient comprising:

a main burner including an air-fuel mixing chamber and a combustion surface having a plurality of orifices in fluid communication with said chamber through which an air-fuel mixture can flow out of said chamber;

a second burner including an air-fuel mixing chamber and at least one orifice in fluid communication with said chamber through which an air-fuel mixture can flow out of said mixing chamber;

a means placing said main burner and second burner air-fuel mixing chambers in fluid communication to allow distribution of air from one of said chambers to the other of said chambers;

a means for supplying a gaseous fuel to said mixing chambers of said main burner and said second burner, said gaseous fuel supply means being in fluid communication with both of said chambers;

a means for igniting and combusting said air-fuel mixture flowing out through said orifices of said main burner and said second burner; and a means for sensing the combustion of said air-fuel mixture at said orifice of said second burner for detecting said oxygen deficiency of said air and for closing said gaseous fuel supply means in response to a detection of an oxygen deficiency in said air-fuel mixture.

2. The apparatus of claim 1 wherein said air supply means includes providing said second burner air-fuel mixing chamber or said main burner chamber with an air inlet.

3. The apparatus of claim 2 wherein said main burner and said second burner mixing chambers are a single common chamber.

4. The apparatus of claim 2 wherein said main burner air-fuel mixing chamber and said second burner air-fuel mixing chamber are placed in said fluid communication by providing said chambers with a common wall having at least a first orifice therethrough.

5. The apparatus of claim 2 wherein said main burner air-fuel mixing chamber and said second burner air-fuel mixing chamber are placed in said fluid communication by a fluid passageway, said fluid passageway being connected at a first end to said main burner air-fuel mixing chamber and at a second opposite end with said second burner air-fuel mixing chamber.

6. The apparatus of claims 3, 4 or 5 wherein said main burner combustion surface is comprised of a material which absorbs and radiates the heat of combustion of said ignited air-fuel mixture.

7. The apparatus of claim 6 wherein said surface is generally planar.

8. The apparatus of claim 7 wherein said adsorbing and radiating surface material is a ceramic material.

9. The apparatus of claim 6 wherein said sensing means is comprised of:

a first thermocouple which creates an electromotive force in response to the detection of said heat of combustion of said air-fuel mixture ignited at said orifice of said second burner, said electromotive force created by said first thermocouple decreasing and increasing as said heat of combustion decreases and increases, respectively;

a valve means associated with said fuel supply means which is retained open by said created electromotive force, said valve means closing said gaseous fuel supply means when said electromotive force created by said first thermocouple decreases below a predefined value to interrupt the supply of said fuel to said second burner and said main burner.

10. The aparatus of claim 9 wherein said gaseous fuel supply means is a fluid conduit to which said air-fuel mixing chambers of said main burner and said second burner are connected in series.

11. The apparatus of claim 10 wherein said valve means is positioned in said conduit prior to said connections to said second burner and said main burner.

12. The apparatus of claim 11 wherein said sensing means further includes a second thermocouple which senses said heat of combustion of said ignited air-fuel mixture at said main burner to create an electromotive force, said electromotive force decreasing and increasing as said heat of combustion decreases and increases respectively.

13. The apparatus of claim 12 wherein said valve means is an electromagnetic valve.

14. The apparatus of claim 13 wherein said first and second thermocouples are connected to said electromagnetic valve in reverse polarity.

15. The apparatus of claim 14 wherein said igniting means includes:

a third burner means connected to said gaseous fuel supply means conduit having an orifice through which said fuel flows, said third burner means orifice juxtaposition said second burner means orifice which is juxtaposition said main burner means; and a spark generating means juxtaposition said third burner means orifice and operable to generate a spark to ignite said fuel establishing a flame which ignites said air-fuel mixture at said second burner means orifice which further ignites the air-fuel mixture at said orifices of said main burner means.

16. The apparatus of claim 15 wherein said spark generating means is a piezo igniter.

17. The apparatus of claim 16 wherein said electromanetic valve is provided with a means for being opened absent said created electromotive force to allow said fuel to pass through said supply means conduit to said main, second and third burner means to allow the igniting of said fuel and said air-fuel mixtures until said electromotive force is created by said first and second thermocouples in response to said heat of combustion.

18. The apparatus of claim 17 wherein said opening means and said piezo igniter are simultaneously operable.

19. The apparatus of claim 18 wherein said third burner is provided with a means for discontinuing the supply of fuel from said gaseous fuel supply means conduit after said air-fuel mixtures at said main and second burner means are ignited.

* * * * *